US011524387B2

(12) United States Patent
Friedman et al.

(10) Patent No.: US 11,524,387 B2
(45) Date of Patent: Dec. 13, 2022

(54) APPARATUS AND METHOD FOR PEENING OF MACHINE COMPONENTS

(71) Applicant: General Electric Company, Schenectady, NY (US)

(72) Inventors: Michael Ericson Friedman, Simpsonville, SC (US); Colin Beckwith Spellmeyer, Greenville, SC (US); Bryan Edward Williams, Greenville, SC (US); Paul Lawrence Kalmar, Zirconia, NC (US)

(73) Assignee: General Electric Company, Schenectady, NY (US)

( * ) Notice: Subject to any disclaimer, the term of this patent is extended or adjusted under 35 U.S.C. 154(b) by 720 days.

(21) Appl. No.: 16/662,279

(22) Filed: Oct. 24, 2019

(65) Prior Publication Data

US 2020/0055165 A1 Feb. 20, 2020

Related U.S. Application Data

(62) Division of application No. 15/097,082, filed on Apr. 12, 2016, now Pat. No. 10,493,594.

(51) Int. Cl.
*B24C 1/10* (2006.01)
*B24C 3/32* (2006.01)
(Continued)

(52) U.S. Cl.
CPC ..... *B24C 1/10* (2013.01); *B21D 31/06* (2013.01); *B24C 3/02* (2013.01); *B24C 3/065* (2013.01); *B24C 3/32* (2013.01); *B24C 9/00* (2013.01)

(58) Field of Classification Search
CPC .... B24C 1/10; B24C 3/02; B24C 3/06; B24C 3/065; B24C 3/32; B24C 9/00; B24B 39/006; B24B 19/14; B21D 31/06
(Continued)

(56) References Cited

U.S. PATENT DOCUMENTS 2,878,624 A 3/1959 Hastrup et al.
3,521,406 A 7/1970 Carpenter, Jr.
(Continued)

FOREIGN PATENT DOCUMENTS

CN 204584986 U 8/2015
CN 107443259 B 12/2017
(Continued)

OTHER PUBLICATIONS

Japanese Office Action issued in connection with corresponding JP Application No. 2017-073362, dated Sep. 21, 2021, 11 pages.
(Continued)

*Primary Examiner* — Eileen P Morgan
(74) *Attorney, Agent, or Firm* — James Pemrick; Charlotte Wilson; Hoffman Warnick LLC

(57) ABSTRACT

A peening device for treating a component includes a shot media propulsion source configured to propel a quantity of shot media. The device also includes a plurality of treatment enclosures each selectively coupleable to the shot media propulsion source. Each of the treatment enclosures has a shape complementary to a corresponding one of a plurality of portions of the component, such that each treatment enclosure and the corresponding portion cooperate to enclose the shot media.

20 Claims, 7 Drawing Sheets

(51) Int. Cl.

| | |
|---|---|
| ***B24C 3/02*** | (2006.01) |
| ***B24C 9/00*** | (2006.01) |
| ***B21D 31/06*** | (2006.01) |
| ***B24C 3/06*** | (2006.01) |

(58) Field of Classification Search
USPC ..... 451/38, 89; 72/53
See application file for complete search history.

(56) References Cited

U.S. PATENT DOCUMENTS

| | | | | |
|---|---|---|---|---|
| 4,395,850 | A * | 8/1983 | Brown | B24C 3/065 D15/126 |
| 4,689,921 | A | 9/1987 | Murate et al. | |
| 4,974,434 | A | 12/1990 | Reccius et al. | |
| 5,742,028 | A | 4/1998 | Mannava et al. | |
| 6,115,917 | A | 9/2000 | Nolan et al. | |
| 6,490,899 | B2 | 12/2002 | Berthelet et al. | |
| 6,505,489 | B2 | 1/2003 | Berthelet et al. | |
| 6,932,876 | B1 | 8/2005 | Statnikov | |
| 7,028,378 | B2 | 4/2006 | Cheppe et al. | |
| 7,644,599 | B2 | 1/2010 | Hoffmann-Ivy et al. | |
| 7,665,338 | B2 * | 2/2010 | Cheppe | C21D 7/06 451/39 |
| 7,673,486 | B2 | 3/2010 | Bayer et al. | |
| 7,992,416 | B2 * | 8/2011 | Stonitsch | B24C 1/10 451/39 |
| 8,997,545 | B1 | 4/2015 | Lundquist et al. | |
| 2002/0056304 | A1 * | 5/2002 | Berthelet | B24B 39/00 72/53 |
| 2008/0282756 | A1 | 11/2008 | Cheppe et al. | |
| 2010/0043512 | A1 | 2/2010 | Bayer et al. | |
| 2011/0179843 | A1 | 7/2011 | Ventzke | |
| 2014/0000330 | A1 | 1/2014 | Hatou et al. | |
| 2015/0013412 | A1 | 1/2015 | Haverty et al. | |

FOREIGN PATENT DOCUMENTS

| | | | | |
|---|---|---|---|---|
| DE | 10 2006 058 677 | A1 | 6/2008 | |
| EP | 1207013 | A1 * | 5/2002 | B24B 1/04 |
| EP | 2111 950 | A1 | 10/2009 | |
| EP | 3231557 | A1 | 10/2017 | |
| GB | 1 251 773 | A | 10/1971 | |
| GB | 2 095 144 | A | 9/1982 | |
| GB | 2 357 255 | A | 6/2001 | |
| JP | S54154895 | A | 12/1979 | |
| JP | 2006-346775 | A1 | 12/2006 | |
| WO | 2008/071163 | A1 | 6/2008 | |

OTHER PUBLICATIONS

Korean Office Action issued in connection with corresponding KR Application No. 10-2017-0046588, dated Apr. 21, 2021, 6 pages.
European Office Action issued in connection with corresponding EP Application No. 17 164 612.8-1017, dated Dec. 17, 2020, 5 pages.
Chinese Office Action issued in connection with corresponding CN Application No. 201710236637.4, dated May 21, 2020, 5 pages.
Chinese Office Action issued in connection with corresponding CN Application No. 201710236637.4, dated Jan. 28, 2021, 7 pages.
Japanese Office Action issued in connection with corresponding JP Application No. 2017-073362 dated May 7, 2021, 7 pages. All art from Japanese Office Action is of record.
Extended European Search Report and Opinion issued in connection with corresponding EP Application No. 17164612.8 dated Aug. 28, 2017.
Non-Final Office Action dated Apr. 30, 2019 for U.S. Appl. No. 15/097,082, filed Apr. 12, 2016; pp. 51.
Notice of Allowance and Fee(s) Due dated Sep. 5, 2019 for U.S. Appl. No. 15/097,082, filed Apr. 12, 2016; pp. 9.

* cited by examiner

APPARATUS AND METHOD FOR PEENING OF MACHINE COMPONENTS

BACKGROUND

The field of the disclosure relates generally to peening, and more particularly, to shot peening of machine components.

At least some known shot peening devices are used to treat components of rotary machines to prevent cracking and improve fatigue life. An excitement or propulsion device propels shot media against the component. The shot media typically includes a plurality of small metallic or ceramic particles that have a spherical shape. When the shot media hits the surface of the component, small spherical dents form on the surface of the part, causing a localized compressive residual stress on the peened surface. The peening treatment assists in mitigating the formation of microcracks on the surface of the component, for example.

Some known peening methods for components include a chamber that enables treatment of the entire surface of the component with shot media. However, by not concentrating or localizing the propulsion of the shot media, there is a greater risk of shot media escaping from the chamber and damaging other parts of the machine. Furthermore, these peening methods may not provide accuracy over a short duration of treatment and therefore may require excessive time and labor to peen each component. In addition, many known forms of peening may only use a fixed peening device that treats only a fixed, i.e. non-rotating, component.

BRIEF DESCRIPTION

In one aspect, a peening device for treating a component is provided. The device includes a shot media propulsion source configured to propel a quantity of shot media. The device also includes a plurality of treatment enclosures each selectively coupleable to the shot media propulsion source. Each of the treatment enclosures has a shape complementary to a corresponding one of a plurality of portions of the component, such that each treatment enclosure and the corresponding portion cooperate to enclose the shot media.

In another aspect, a set of treatment enclosures for a peening device is provided. The peening device is configured for treating a component. The set of treatment enclosures includes a first treatment enclosure selectively coupleable to a shot media propulsion source of the peening device. The first treatment enclosure has a shape complementary to a first surface of the component, such that the first treatment enclosure and the first surface cooperate to enclose the shot media. The device further includes a second treatment enclosure selectively coupleable to the shot media propulsion source. The second treatment enclosure has a shape complementary to a second surface of the component, such that the second treatment enclosure and the second surface cooperate to enclose the shot media.

In another aspect, a method of treating a component using a peening device is provided. The peening device includes a shot media propulsion source. The method includes coupling a first of a plurality of treatment enclosures to the shot media propulsion source, and positioning the peening device with respect to a first portion of the component. The method also includes activating the shot media propulsion source. The first treatment enclosure has a shape complementary to the first portion of the component, such that the first treatment enclosure and the first portion cooperate to enclose shot media propelled by the shot media propulsion source.

The method further includes coupling a second of the plurality of treatment enclosures to the shot media propulsion source, and positioning the peening device with respect to a second portion of the component. In addition, the method includes reactivating the shot media propulsion source. The second treatment enclosure has a shape complementary to the second portion of the component, such that the second treatment enclosure and the second portion cooperate to enclose shot media propelled by the shot media propulsion source.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

The peening device described herein facilitates the peening of components of machines, such as, but not limited to, rotary machine components. The component defines a perimeter that includes a series of surfaces. The peening device described herein includes a plurality of selectable treatment enclosures that are each configured for treating a corresponding surface of the component. For example, in some embodiments, the component includes at least one rotationally symmetric surface, and the shape of the treatment enclosures facilitates peen treatment of such a surface while the component is rotated. For another example, the component includes at least one slot defined therein, and the shape of the treatment enclosures facilitates localized peen treatment of the surfaces that define the slot.

Figure 1:
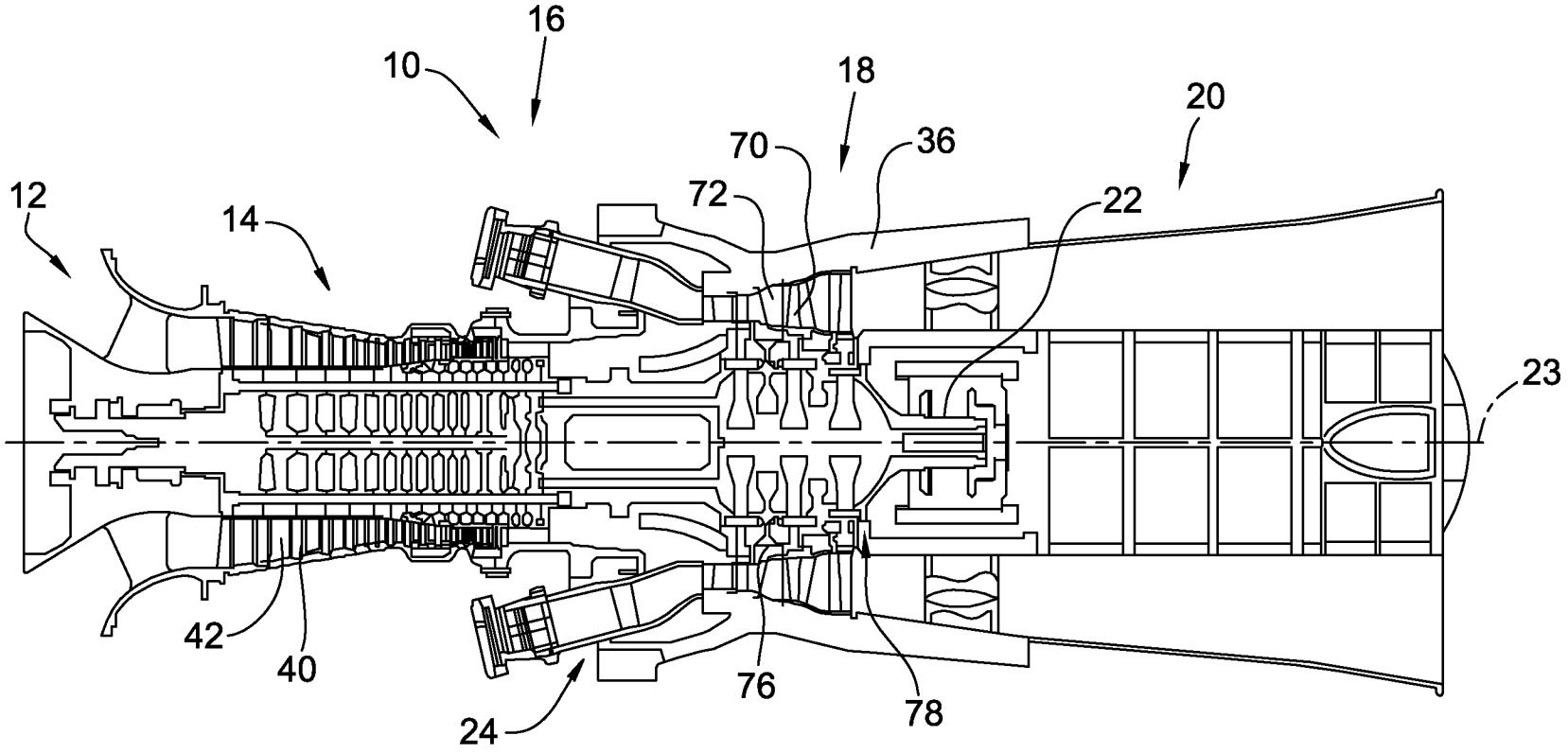
FIG. 1 is a schematic view of an exemplary rotary machine.

FIG. 1 is a schematic view of an exemplary rotary machine 10. In the exemplary embodiment, rotary machine 10 is a gas turbine that includes an intake section 12, a compressor section 14 coupled downstream from intake section 12, a combustor section 16 coupled downstream from compressor section 14, a turbine section 18 coupled downstream from combustor section 16, and an exhaust section 20 coupled downstream from turbine section 18. A generally tubular casing 36 at least partially encloses one or more of intake section 12, compressor section 14, combustor section 16, turbine section 18, and exhaust section 20. In alternative embodiments, rotary machine 10 is any rotary machine for which components formed with internal passages as described herein are suitable. Moreover, although embodiments of the present disclosure are described in the context of a rotary machine for purposes of illustration, it should be understood that the embodiments described herein are applicable in any context that involves a component suitably formed with an internal passage defined therein.

In the exemplary embodiment, turbine section 18 is coupled to compressor section 14 via a rotor shaft 22. It should be noted that, as used herein, the term "couple" is not limited to a direct mechanical, electrical, and/or communication connection between components, but may also include an indirect mechanical, electrical, and/or communication connection between multiple components. Rotor shaft 22 defines an axis 23.

During operation of rotary machine 10, intake section 12 channels air towards compressor section 14. Compressor section 14 compresses the air to a higher pressure and temperature. More specifically, rotor shaft 22 imparts rotational energy to at least one circumferential row of compressor blades 40 coupled to rotor shaft 22 within compressor section 14. In the exemplary embodiment, each row of compressor blades 40 is preceded by a circumferential row of compressor stator vanes 42 extending radially inward from casing 36 that direct the air flow into compressor blades 40. The rotational energy of compressor blades 40 increases a pressure and temperature of the air. Compressor section 14 discharges the compressed air towards combustor section 16.

In combustor section 16, the compressed air is mixed with fuel and ignited to generate combustion gases that are channeled towards turbine section 18. More specifically, combustor section 16 includes at least one combustor 24, in which a fuel, for example, natural gas and/or fuel oil, is injected into the air flow, and the fuel-air mixture is ignited to generate high temperature combustion gases that are channeled towards turbine section 18.

Turbine section 18 converts the thermal energy from the combustion gas stream to mechanical rotational energy. More specifically, the combustion gases impart rotational energy to at least one circumferential row of rotor blades 70 coupled to rotor shaft 22 within turbine section 18. In certain embodiments, each row of rotor blades 70 is spaced apart along rotor shaft 22 from an adjacent row of rotor blades 70 by a turbine spacer 76. In the exemplary embodiment, each row of rotor blades 70 is preceded by a circumferential row of turbine stator vanes 72 extending radially inward from casing 36 that direct the combustion gases into rotor blades 70. In some embodiments, an aft shaft 78 defines an aft portion of rotor shaft 22. Rotor shaft 22 may be coupled to a load (not shown) such as, but not limited to, an electrical generator and/or a mechanical drive application. The exhausted combustion gases flow downstream from turbine section 18 into exhaust section 20.

Figure 2:
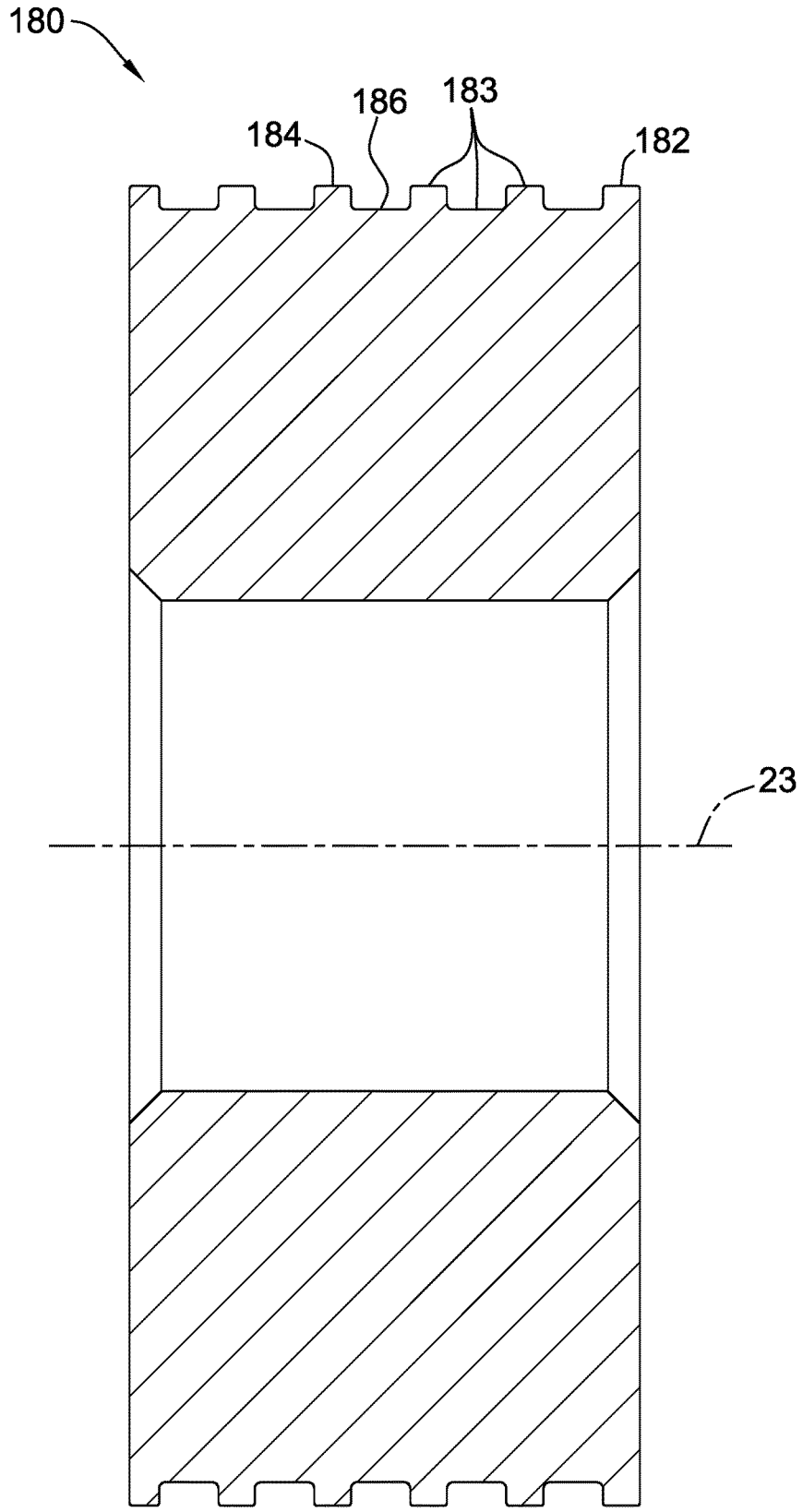
FIG. 2 is a schematic cross-sectional view of an enlarged exemplary component of the rotary machine shown in FIG. 1.

FIG. 2 is a schematic cross-sectional view of an exemplary component 180 of rotary machine 10 (shown in FIG. 1). Component 180 includes an axially-extending perimeter 182 that is defined by a plurality of portions 183. In the exemplary embodiment, each perimeter portion 183 has a symmetric shape about rotor axis 23. More specifically, in the illustrated embodiment, component 180 is turbine spacer 76 (shown in FIG. 1). In alternative embodiments, component 180 is any other suitable component of rotor 22.

For example, in the exemplary embodiment, portions 183 include a plurality of positive surfaces 184 and a plurality of negative surfaces 186 that are arranged in a series relationship. Each positive surface 184 extends radially outward to a greater extent than each adjacent negative surface 186. Moreover, in the exemplary embodiment, each positive surface 184 has a substantially identical shape, and each negative surface 186 has a substantially identical shape. In alternative embodiments, at least one positive surface 184 is shaped differently from at least one other positive surface 184, and/or at least one negative surface 186 is shaped differently from at least one other negative surface 186. In other alternative embodiments, portions 183 may have any other suitable combination of symmetric shapes extending about rotor axis 23.

Figure 3:
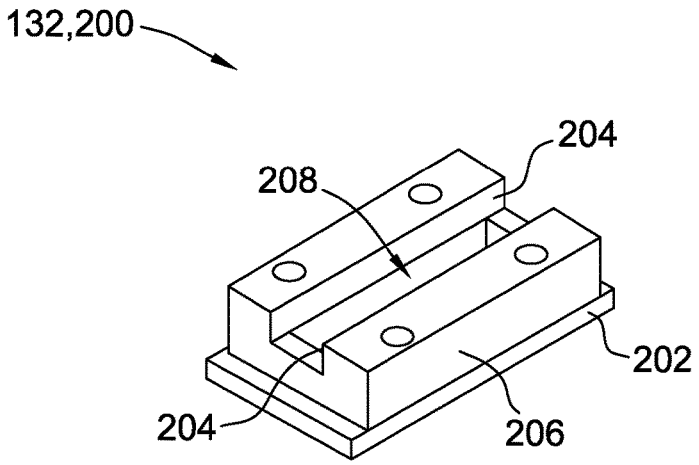
FIG. 3 is a schematic perspective view of an exemplary peen treatment enclosure for use with the component shown in FIG. 2.
Figure 4:
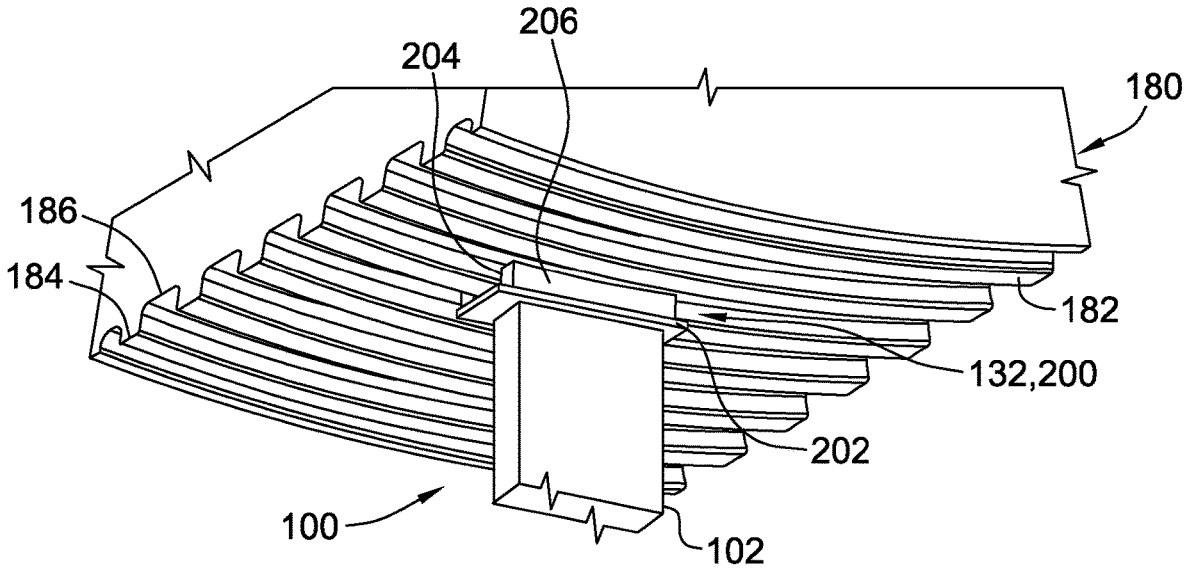
FIG. 4 is a perspective view of an exemplary peening device, including the peen treatment enclosure shown in FIG. 3, coupled to the component shown in FIG. 2.

FIG. 3 is a schematic perspective view of an exemplary first peen treatment enclosure 132 for use with component 180 (shown in FIG. 2). FIG. 4 is a perspective view of an exemplary peening device 100 including first peen treatment enclosure 132 coupled to component 180. With reference to FIGS. 3 and 4, first peen treatment enclosure 132 is one of a plurality of peen treatment enclosures 132 each selectively coupleable to peening device 100. Each peen treatment enclosure 132 has a shape that is substantially complementary to a corresponding portion 183 of component perimeter 182. As such, each peen treatment enclosure 132 and corresponding perimeter portion 183 cooperate to enclose shot media (not shown) used for peening as component 180 is rotated relative to peening device 100.

For example, in the exemplary embodiment, first peen treatment enclosure 132 is shaped to be complementary to at least one of positive surfaces 184 of component perimeter 182. First peen treatment enclosure 132, designated positive treatment enclosure 200 in the illustrated embodiment, includes an interface 202 and a positive treatment chamber 206 coupled to interface 202. Positive treatment chamber 206 includes a pair of opposing side walls 204 configured to extend circumferentially adjacent perimeter 182, and to receive positive surface 184 of component perimeter 182 therebetween. More specifically, chamber 206 defines a U-shaped groove that is complementary to outwardly jutting positive surface 184.

An aperture 208 extends through interface 202 and positive treatment chamber 206. Interface 202 is configured for coupling to a shot media propulsion source 102 of peening device 100, such that aperture 208 enables shot media (not shown) accelerated by propulsion source 102 to contact the portion of positive surface 184 that is enclosed by positive treatment chamber 206, while chamber 206 inhibits the shot media from contacting other surfaces of component 180 and/or escaping into the environment. In some embodiments, a length of chamber 206, measured parallel to walls 204, is much shorter than a circumference of component 180, facilitating increased accuracy and/or concentration of peening along selected portions of perimeter 182 as component 180 is rotated relative to peening device 100. In alternative embodiments, the length of chamber 206 is other than much shorter than the circumference of component 180.

Figure 5:
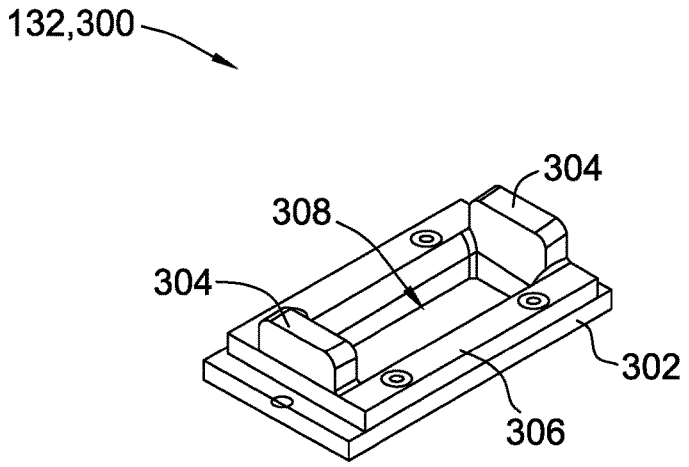
FIG. 5 is a schematic perspective view of another exemplary peen treatment enclosure for use with the component shown in FIG. 2.
Figure 6:
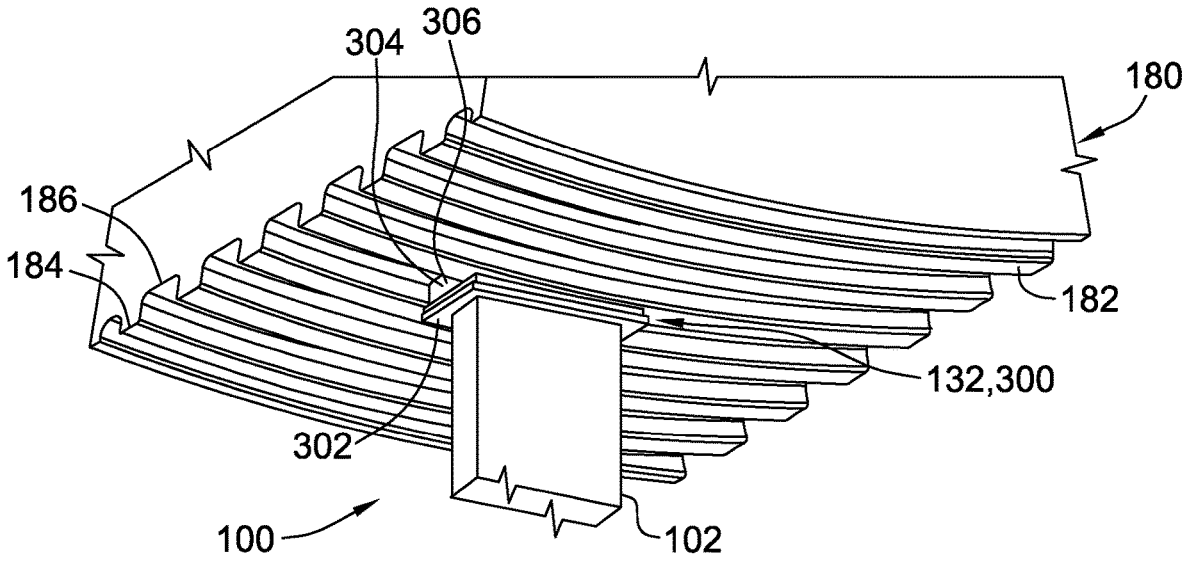
FIG. 6 is a perspective view of an exemplary peening device, including the peen treatment enclosure shown in FIG. 5, coupled to the component shown in FIG. 2.

FIG. 5 is a schematic perspective view of an exemplary second peen treatment enclosure 132 for use with component 180 (shown in FIG. 2). FIG. 6 is a perspective view of peening device 100 including second peen treatment enclosure 132 coupled to component 180. With reference to FIGS. 5 and 6, second peen treatment enclosure 132, designated as a negative treatment enclosure 300 in the illustrated embodiment, is shaped to be complementary to at least one of negative surfaces 186 of component perimeter 182. More specifically, in the exemplary embodiment, negative treatment enclosure 300 includes an interface 302 and a negative treatment chamber 306 coupled to interface 302. Negative treatment chamber 306 includes a pair of opposing side walls 304 configured to extend axially adjacent perimeter 182, and to be received by negative surface 186 of component perimeter 182. More specifically, chamber 306 defines inverted U-shaped ends that are substantially complementary to inwardly-recessed negative surface 186.

An aperture 308 extends through interface 302 and negative treatment chamber 306. Interface 302 is configured for coupling to shot media propulsion source 102 of peening device 100, such that aperture 308 enables shot media (not shown) accelerated by propulsion source 102 to contact the portion of negative surface 186 that is enclosed by negative treatment chamber 306, while chamber 306 inhibits the shot media from contacting other surfaces of component 180 and/or escaping into the environment. In some embodiments, a length of chamber 306, measured between walls 304, is much shorter than a circumference of component 180, facilitating increased accuracy and/or concentration of peening along selected portions of perimeter 182 as component 180 is rotated relative to peening device 100. In alternative embodiments, the length of chamber 306 is other than much shorter than the circumference of component 180.

In operation, with reference to FIGS. 1-6, to peen perimeter 182 of component 180, positive treatment enclosure 200 is coupled to peening device 100. Shot media (not shown) is loaded into device 100. Peening device 100 is positioned with respect to component 180, such that chamber 206 couples against a corresponding one of the plurality of positive surfaces 184 on perimeter 182 of component 180. Component 180 is then rotated about axis 23 relative to peening device 100, and shot media propulsion source 102 is activated to project the shot media repeatedly towards component 180. Positive treatment chamber 206 and positive surface 184 cooperate to enclose the shot media while component 180 is rotated relative to peening device 100. Once a cycle of treatment is completed, for example by completing a selected number of rotations of component 180, shot media propulsion source 102 is deactivated, peening device 100 is repositioned such that chamber 206 is coupled to another of positive surfaces 184, and the peening operation is repeated. Subsequently, negative treatment enclosure 300 is coupled to peening device 100, and a similar procedure is used to couple negative treatment enclosure 300 to, and peen, each corresponding negative surface 186 of component 180. In alternative embodiments, component 180 remains stationary during peening treatment and peening device 100 is instead rotated around component 180.

Figure 7:
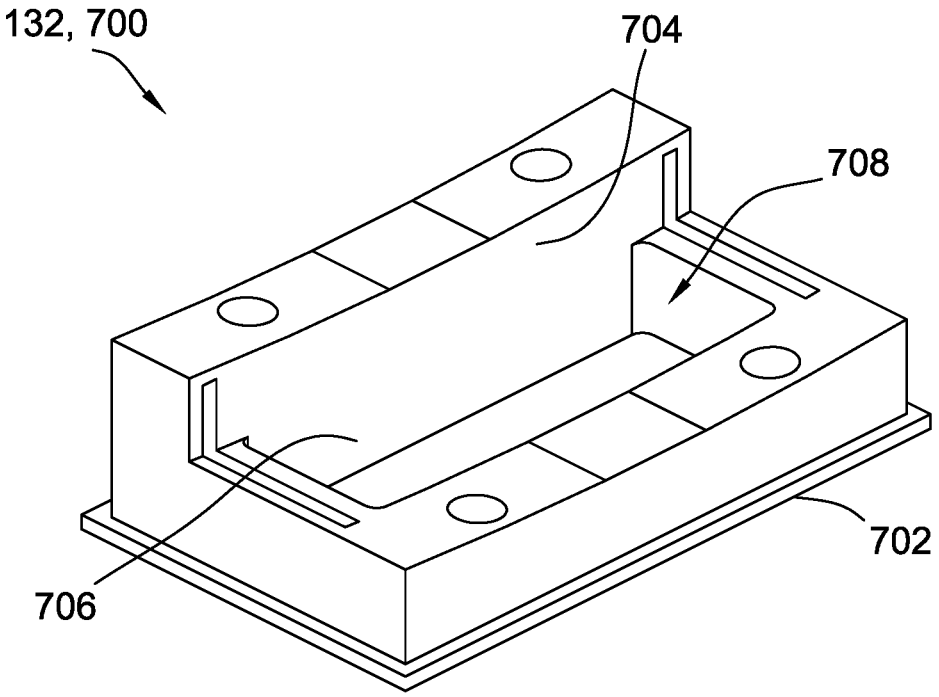
FIG. 7 is a schematic perspective view of another exemplary peen treatment enclosure.
Figure 8:
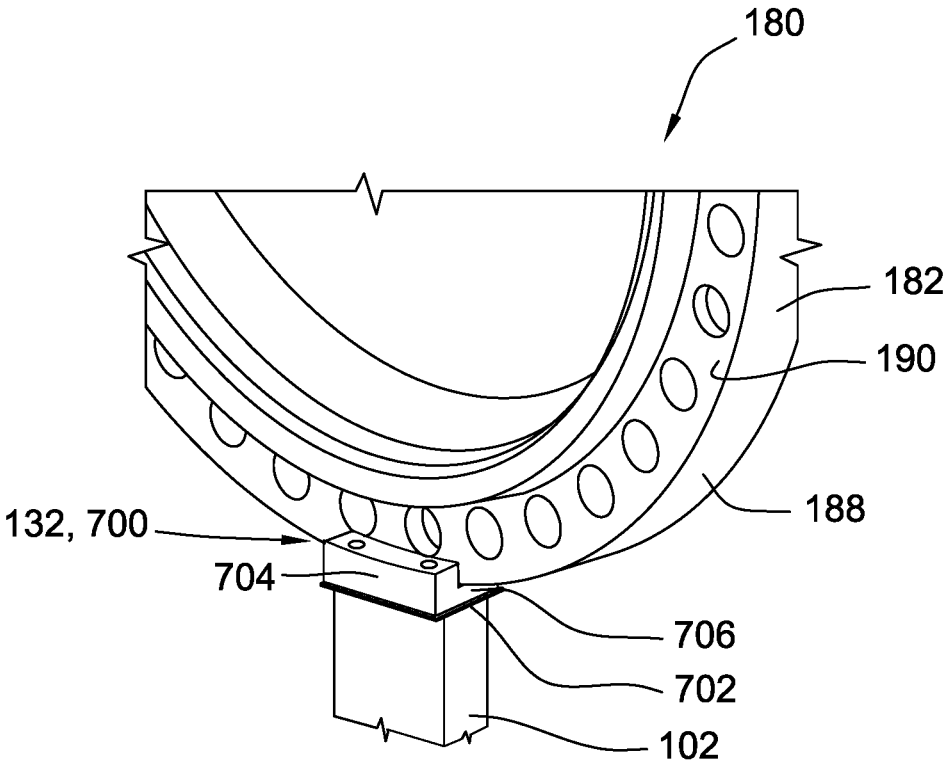
FIG. 8 is a perspective view of an exemplary peening device, including the peen treatment enclosure shown in FIG. 7, coupled to another exemplary component of the rotary machine shown in FIG. 1.

FIG. 7 is a schematic perspective view of an exemplary third peen treatment enclosure 132 for use with peening device 100. FIG. 8 is a perspective view of peening device 100 including third peen treatment enclosure 132 coupled to another exemplary component 180 of rotary machine 10 (shown in FIG. 1). In the illustrated embodiment, perimeter portions 183 of component 180 include a rim surface 188 and an adjacent side surface 190. More specifically, in the illustrated embodiment, component 180 is aft shaft 78 (shown in FIG. 1). In alternative embodiments, component 180 is any other suitable component of rotor 22.

With reference to FIGS. 7 and 8, third peen treatment enclosure 132, designated as a rim treatment enclosure 700 in the illustrated embodiment, is shaped to be complementary to rim surface 188 of component perimeter 182. More specifically, in the exemplary embodiment, rim treatment enclosure 700 includes an interface 702 and a rim treatment chamber 706 coupled to interface 702. Rim treatment chamber 706 includes a side wall 704 configured to extend axially adjacent perimeter 182, and to couple against side surface 190 of component perimeter 182 adjacent rim surface 188. More specifically, chamber 706 defines a half-U-shape that is substantially complementary to rim surface 188 and adjacent side surface 190.

An aperture 708 extends through interface 702 and rim treatment chamber 706. Interface 702 is configured for coupling to shot media propulsion source 102 of peening device 100, such that aperture 708 enables shot media (not shown) accelerated by propulsion source 102 to contact the portion of rim surface 188 that is enclosed by rim treatment chamber 706, while chamber 706 inhibits the shot media from contacting other surfaces of component 180 and/or escaping into the environment. In some embodiments, a length of chamber 706, measured parallel to wall 704, is much shorter than a circumference of component 180, facilitating increased accuracy and/or concentration of peening along selected portions of perimeter 182 as component 180 is rotated relative to peening device 100. In alternative embodiments, the length of chamber 706 is other than much shorter than the circumference of component 180.

In operation, to peen perimeter 182 of component 180, similar to as described above, rim treatment enclosure 700 is coupled to peening device 100. Shot media (not shown) is loaded into device 100. Peening device 100 is positioned with respect to component 180, such that chamber 706 couples against rim surface 188 on perimeter 182 of component 180. Component 180 is then rotated about axis 23 relative to peening device 100, and shot media propulsion source 102 is activated to project the shot media repeatedly towards component 180. Rim treatment chamber 706 and rim surface 188 cooperate to enclose the shot media while component 180 is rotated relative to peening device 100. In alternative embodiments, component 180 remains stationary during peening treatment and peening device 100 is instead rotated around component 180.

In alternative embodiments, perimeter portions 183 may have any other suitable combination of shapes extending symmetrically about rotor axis 23, and the plurality of treatment enclosures 132 includes a corresponding treatment enclosure 132 that has a shape complementary to each such portion 183.

Figure 9:
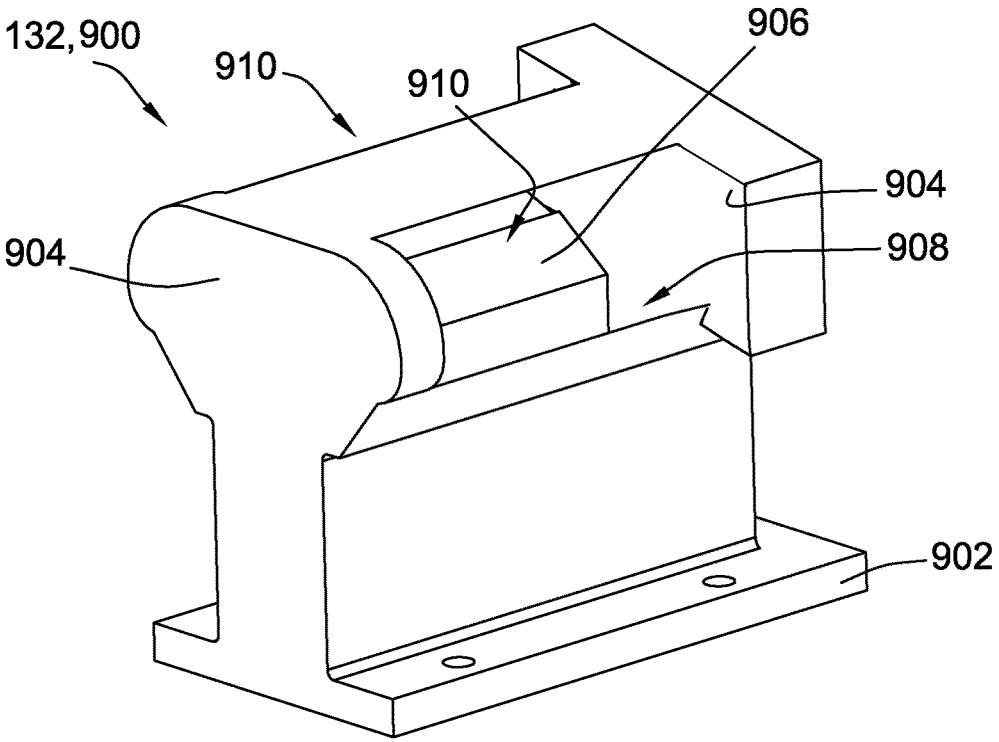
FIG. 9 is a schematic perspective view of another exemplary peen treatment enclosure.
Figure 10:
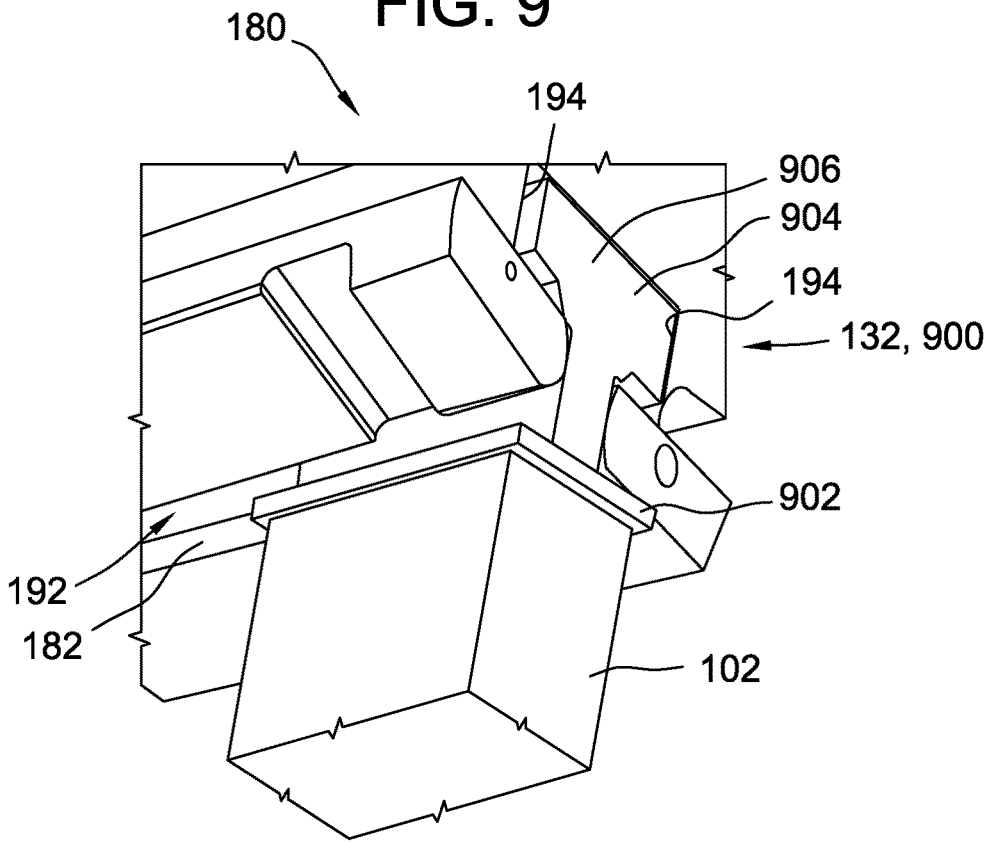
FIG. 10 is a perspective view of an exemplary peening device, including the peen treatment enclosure shown in FIG. 9, coupled to another exemplary component of the rotary machine shown in FIG. 1.

In certain embodiments, component 180 remains stationary during peening treatment of some perimeter portions 183 by peening device 100. For example, but not by way of limitation, in certain embodiments, perimeter 182 includes at least one portion 183 that is not symmetric about rotor axis 23. FIG. 9 is a schematic perspective view of an exemplary fourth peen treatment enclosure 132 for use with peening device 100. FIG. 10 is a perspective view of peening device 100 including fourth peen treatment enclosure 132 coupled to another exemplary component 180 of rotary machine 10 (shown in FIG. 1). In the illustrated embodiment, perimeter portions 183 of component 180 include dovetail slots 192 each having a pair of opposing side walls 194. More specifically, in the illustrated embodiment, component 180 is a turbine disk body configured to hold a row of circumferential rotor blades 70 (shown in FIG. 1) each having a dovetail root (not shown) shaped to be received in a corresponding dovetail slot 192. In alternative embodiments, component 180 is any other suitable component of rotor 22.

With reference to FIGS. 9 and 10, fourth peen treatment enclosure 132, designated as a dovetail slot treatment enclosure 900 in the illustrated embodiment, is shaped to be complementary to dovetail slot 192 of component perimeter 182. More specifically, in the exemplary embodiment, dovetail slot treatment enclosure 900 includes an interface 902 and a dovetail slot treatment chamber 906 coupled to interface 902. Dovetail slot treatment chamber 906 includes a pair of opposing side walls 904 configured to be slidably received by dovetail slot 192 and to extend normal to dovetail slot 192. More specifically, chamber 906 defines a shape that is substantially complementary to dovetail slot 192.

An aperture 908 extends through interface 902 and dovetail slot treatment chamber 906. In the exemplary embodiment, aperture 908 distal from interface 902 divides into a pair of opposing side apertures 910, and each side aperture 910 is configured for positioning adjacent a respective side wall 194 of dovetail slot 192 when dovetail slot treatment enclosure 900 is received in dovetail slot 192. Interface 902 is configured for coupling to shot media propulsion source 102 of peening device 100, such that aperture 908 enables shot media (not shown) accelerated by propulsion source 102 to contact the portion of dovetail side walls 194 that is enclosed by rim treatment chamber 906, while chamber 906 inhibits the shot media from contacting other surfaces of component 180 and/or escaping into the environment. In some embodiments, a length of chamber 906, measured parallel to dovetail slot 192, is shorter than a length of dovetail slot 192, facilitating increased accuracy and/or concentration of peening along selected portions of perimeter 182. In alternative embodiments, the length of chamber 906 is other than shorter than the length of dovetail slot 192.

In operation, to peen perimeter 182 of dovetail slot 192, dovetail slot treatment enclosure 900 is coupled to peening device 100. Shot media (not shown) is loaded into device 100. Peening device 100 is positioned with respect to component 180, such that chamber 906 is received by dovetail slot 192, and such that side apertures 910 are positioned adjacent dovetail side walls 194 on perimeter 182 of component 180. Shot media propulsion source 102 is activated to project the shot media repeatedly towards component 180. Once a cycle of treatment is completed, shot media propulsion source 102 is deactivated, peening device 100 is repositioned such that chamber 906 is coupled to another portion of dovetail slot 192 or received by another dovetail slot 192, and the peening operation is repeated. In certain embodiments, fourth peen treatment enclosure 132 facilitates improved accuracy and precision of peen treatment of slots defined in component 180, as compared to enclosures (not shown) configured to peen large sections of component 180 simultaneously.

In alternative embodiments, perimeter portions 183 may have any other suitable combination of shapes, and the plurality of treatment enclosures 132 includes a corresponding treatment enclosure 132 that has a shape complementary to each such portion 183.

Peening device 100 includes any suitable shot media propulsion source 102 that enables shot media to be delivered to peen treatment enclosures 132 with sufficient energy to peen a surface of component perimeter 182 with a selected effectiveness. For example, but not by way of limitation, shot media propulsion source 102 includes a suitable centrifugal blast wheel to propel shot media. For another example, but not by way of limitation, shot media propulsion source 102 includes a suitable air blast system to propel shot media. For another example, but not by way of limitation, shot media propulsion source 102 includes a suitable ultrasonic excitation source to propel shot media. In some embodiments, peening device 100 further includes a suitable vacuum system (not shown) for recovery of spent shot media.

Figure 11:
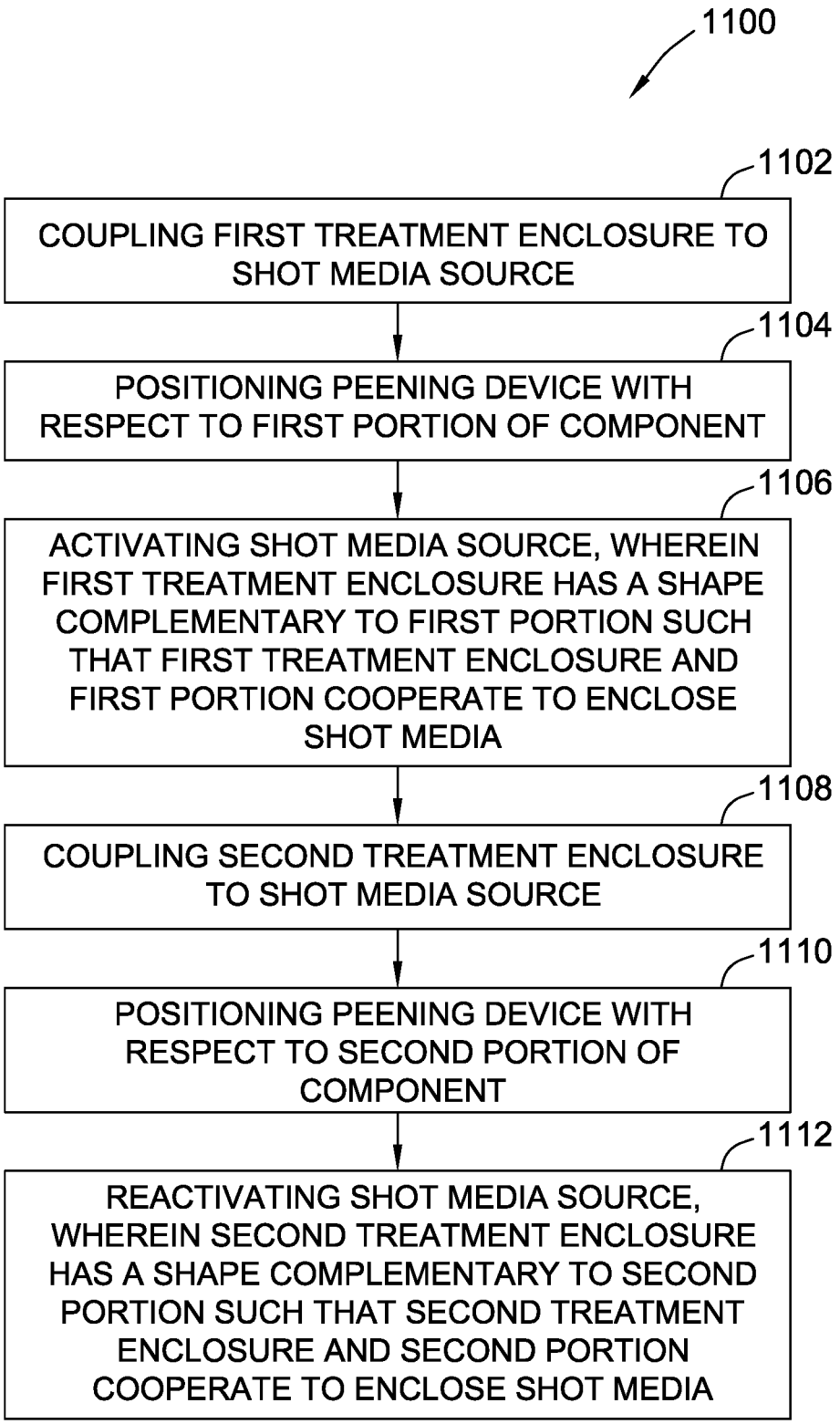
FIG. 11 is a flow diagram of an exemplary method of treating a component, such as the components shown in FIG. 1, using a peening device, such as the peening device shown in FIGS. 3-10.

FIG. 11 is a flow diagram of an exemplary method 1100 of treating a component, such as component 180, using a peening device, such as peening device 100. With reference to FIGS. 1-11, in the exemplary embodiment, the peening device includes a shot media propulsion source, such as shot media propulsion source 102. Method 1100 includes coupling 1102 a first of a plurality of treatment enclosures, such as a first one of treatment enclosures 132, to the shot media propulsion source, and positioning 1104 the peening device with respect to a first portion of the component, such as a first one of portions 183 of perimeter 182. Method 1100 also includes activating 1106 the shot media propulsion source. The first treatment enclosure has a shape complementary to the first portion of the component, such that the first treatment enclosure and the first portion cooperate to enclose shot media propelled by the shot media propulsion source.

Method 1100 further includes coupling 1108 a second of the plurality of treatment enclosures, such as a second one of treatment enclosures 132, to the shot media propulsion source, and positioning 1110 the peening device with respect to a second portion of the component, such as a second one of portions 183 of perimeter 182. In addition, method 1100 includes reactivating 1112 the shot media propulsion source. The second treatment enclosure has a shape complementary to the second portion of the component, such that the second treatment enclosure and the second portion cooperate to enclose shot media propelled by the shot media propulsion source.

Embodiments of the peening device described herein provide several advantages over known peening devices. Specifically, the embodiments provide for peening multiple portions of a component using selectable treatment enclosures attachable in series to a single peening device. More specifically, each of the treatment enclosures is shaped complementarily to a corresponding portion of the component. In certain embodiments, the selectable treatment enclosures enable peening of at least a portion of a circumferential surface of a component while the component is rotated. For example, at least some known components include a circumferential surface that includes a series of positive and negative surfaces, wherein the positive surfaces extend radially to a greater extent than the negative surfaces. In such cases, the peening device described herein includes two treatment enclosures attachable in sequence, each for treating a respective surface of the component while the component is rotated. The shape of the treatment enclosures improves the treatment of the surface of the component. In addition, the embodiments provided herein provide concentrated or localized propulsion of shot media, facilitating a reduced risk of shot media escaping from the chamber and damaging other parts of the machine, and/or improved accuracy over a short duration of treatment.

An exemplary technical effect of the methods, systems, and apparatus described herein includes at least one of: (a) improving the quality and uniformity of peen treatment of components having portions with multiple surface configurations; (b) enabling use of a standardized device with interchangeable portions to treat multiple portions of a component; (c) improving the service life of the components; and (d) enabling a single set-up and operation for peening of each portion of rotationally symmetric components, reducing the amount of time required and the manpower spent on maintaining the components.

Exemplary embodiments of a peening device are described above in detail. The peening device and methods of manufacturing or operating such a system and device are not limited to the specific embodiments described herein, but rather, components of systems and/or steps of the methods may be utilized independently and separately from other components and/or steps described herein. For example, the systems, apparatus, and methods may also be used in combination with other types of peening devices, and are not limited to practice with only the peening devices, systems and methods as described herein. Rather, the exemplary embodiment can be implemented and utilized in connection with many other applications, equipment, and systems.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A set of treatment enclosures for a peening device, the peening device configured for treating a component, the set of treatment enclosures comprising:

a first treatment enclosure configured to mate with a first corresponding portion of the component including a dovetail slot, the first treatment enclosure including:

a first chamber, a first interface coupled to the first chamber, the first interface configured to removably attach to a shot media propulsion source of the peening device, and a first aperture extending through the first interface and the first chamber for the shot media propulsion source to propel a quantity of shot media therethrough to the component, wherein a portion of the first aperture distal from the first interface divides into a pair of opposing side apertures, the pair of opposing side apertures configured, respectively, for positioning adjacent one of two opposing side portions of the dovetail slot of the component, such that the quantity of shot media contacts only the two opposing side portions of the dovetail slot during operation of the peening device; and a second treatment enclosure configured to mate with a second corresponding portion of the component, the second treatment enclosure including:

a second chamber, a second interface coupled to the second chamber, the second interface configured to removably attach to the shot media propulsion source of the peening device, and a second aperture extending through the second interface and the second chamber for the shot media propulsion source to propel the quantity of shot media therethrough to the second corresponding portion of the component.

2. The set of treatment enclosures of claim 1, wherein the second corresponding portion of the component includes a circumferentially extending positive surface of the component, and wherein the second treatment enclosure includes a positive treatment enclosure that is complementary to and configured to treat the positive surface of the component.

3. The set of treatment enclosures of claim 2, wherein the chamber of the second treatment enclosure includes a pair of opposing side walls configured to extend circumferentially adjacent the component, the pair of opposing side walls define a U-shaped groove.

4. The set of treatment enclosures of claim 1, wherein the first corresponding portion of the component includes a circumferentially extending negative surface of the component, and wherein the first treatment enclosure includes a negative treatment enclosure that is complementary to and configured to treat the negative surface of the component.

5. The set of treatment enclosures of claim 4, wherein the chamber of the first treatment enclosure includes a pair of opposing side walls configured to extend axially adjacent the component, such that the opposing side walls are received by the negative surface of the component.

6. The set of treatment enclosures of claim 1, wherein the first treatment enclosure includes a dovetail slot treatment enclosure configured to be received by the dovetail slot of the component.

7. The set of treatment enclosures of claim 1, wherein the second treatment enclosure includes a rim treatment enclosure configured to mate with a rim of the second corresponding portion of the component.

8. The set of treatment enclosures of claim 7, wherein the rim treatment enclosure includes a chamber having a side wall to define a half U-shaped groove.

9. The set of treatment enclosures of claim 8, wherein the half U-shaped groove is substantially complementary to the rim of the second corresponding portion of the component for the rim treatment enclosure to enclose the rim, such that the quantity of shot media contacts only the rim during operation of the peening device.

10. The set of treatment enclosures of claim 1, wherein the chamber of at least one of the first treatment enclosure or the second treatment enclosure includes a shape that corresponds to and is configured to treat a rotationally symmetric first corresponding portion of the component or a rotationally symmetric second corresponding portion of the component when the component is rotated.

11. The set of treatment enclosures of claim 10, wherein at least one of the first treatment enclosure or the second treatment enclosure is configured to remain stationary when the component is rotated.

12. A method of treating a component using a peening device, the peening device including a shot media propulsion source, the method comprising:

coupling a first treatment enclosure to the shot media propulsion source, the first treatment enclosure including:

a first chamber, a first interface coupled to the first chamber, the first interface removably coupled to the shot media propulsion source, and a first aperture extending through the first interface and the first chamber, the first aperture including a portion distal from the first interface that divides into a pair of opposing side apertures;

positioning the first treatment enclosure of the peening device with respect to a first portion of the component including a dovetail slot, such that the pair of opposing side apertures of the first treatment enclosure are positioned adjacent one of two opposing side portions of the dovetail slot of the component; and activating the shot media propulsion source, such that a quantity of shot media contacts only the two opposing side portions of the dovetail slot.

13. The method of claim 12, further comprising:

coupling a second treatment enclosure to the shot media propulsion source, the second treatment enclosure including:

a second chamber, a second interface coupled to the second chamber, the second interface removably coupled to the shot media propulsion source, and a second aperture extending through the second interface and the second chamber;

positioning the second treatment enclosure of the peening device with respect to a second portion of the component; and reactivating the shot media propulsion source, wherein the second treatment enclosure and the second portion cooperate to enclose the shot media propelled by the shot media propulsion source.

14. The method of claim 13, further comprising:

rotating the component subsequent to one of:

positioning the first treatment enclosure of the peening device with respect to a first portion of the component, or positioning the second treatment enclosure of the peening device with respect to a second portion of the component, wherein at least one of the first treatment enclosure or the second treatment enclosure is configured to treat a rotationally symmetric first portion of the component or a rotationally symmetric second portion of the component.

15. The method of claim 14, further comprising:

maintaining a stationary position for at least one of the first treatment enclosure or the second treatment enclosure when the component is rotated.

16. The method of claim 13, wherein the second portion of the component includes a circumferentially extending positive surface of the component, wherein the second treatment enclosure includes a positive treatment enclosure that is complementary to and configured to treat the positive surface of the component.

17. The method of claim 16, wherein the chamber of the second treatment enclosure includes a pair of opposing side walls configured to extend circumferentially adjacent the component, the pair of opposing side walls define a U-shaped groove.

18. The method of claim 13, wherein the second treatment enclosure includes a rim treatment enclosure configured to mate with a rim of the second portion of the component.

19. The method of claim 18, wherein the rim treatment enclosure includes a chamber having a side wall to define a half U-shaped groove.

20. The method of claim 19, wherein the half U-shaped groove is substantially complementary to the rim of the second portion of the component for the rim treatment enclosure to enclose the rim, such that the quantity of shot media contacts only the rim during operation of the peening device.

* * * * *